United States Patent [19]

Gash et al.

[11] Patent Number: 4,648,450

[45] Date of Patent: Mar. 10, 1987

[54] METHOD OF PRODUCING SYNTHESIS GAS BY UNDERGROUND GASIFICATION OF COAL USING SPECIFIC WELL CONFIGURATION

[75] Inventors: Bruce W. Gash; Luis E. Arri; Elton B. Hunt, Jr.; David R. Parrish, all of Tulsa, Okla.

[73] Assignee: Amoco Corporation, Chicago, Ill.

[21] Appl. No.: 802,800

[22] Filed: Nov. 27, 1985

[51] Int. Cl.[4] ..... C10B 57/20; E21B 43/243

[52] U.S. Cl. ..... 166/259; 166/251/261; 48/DIG. 6

[58] Field of Search ..... 166/245, 251, 256, 258, 166/259, 261, 50; 299/2, 6; 48/DIG. 6

[56] References Cited

U.S. PATENT DOCUMENTS

| | | | |
|---|---|---|---|
| 2,466,945 | 4/1949 | Greene | 299/6 X |
| 3,563,606 | 2/1971 | Sears | 166/259 X |
| 3,770,398 | 11/1973 | Abraham et al. | 166/256 X |
| 3,933,447 | 1/1976 | Pasini, III et al. | 166/259 X |
| 4,220,203 | 9/1980 | Steeman | 166/259 X |
| 4,228,856 | 10/1980 | Reale | 166/256 |
| 4,243,101 | 1/1981 | Grupping | 166/261 |
| 4,334,579 | 1/1982 | Gregg | 166/256 |
| 4,422,505 | 12/1983 | Collins | 166/256 |
| 4,423,906 | 1/1984 | Studebaker | 166/251 X |
| 4,451,088 | 5/1984 | Nisseroth | 299/13 X |

OTHER PUBLICATIONS

Olness, *The Angrenskaya Underground Coal Gasification Station,* UCRL-53300, Lawrence Livermore Laboratory, University of California at Livermore, Jun. 17, 1982.

*Primary Examiner*—George A. Suchfield
*Attorney, Agent, or Firm*—F. E. Hook; R. R. Cochran; T. H. Briggs

[57] ABSTRACT

Underground coal gasification process containing a novel system of injection and production wells. Specifically, the injection well is positioned at an angle with respect to horizontal of less than the angle of repose of loose coal and char for the particular coal seam, and the production well is positioned at an angle with respect to horizontal of greater than the angle of repose but less than 90°. This system protects the injection well during the process and places the production well in a position for maximum production while relieving it of certain tensile and shear stresses.

11 Claims, 1 Drawing Figure

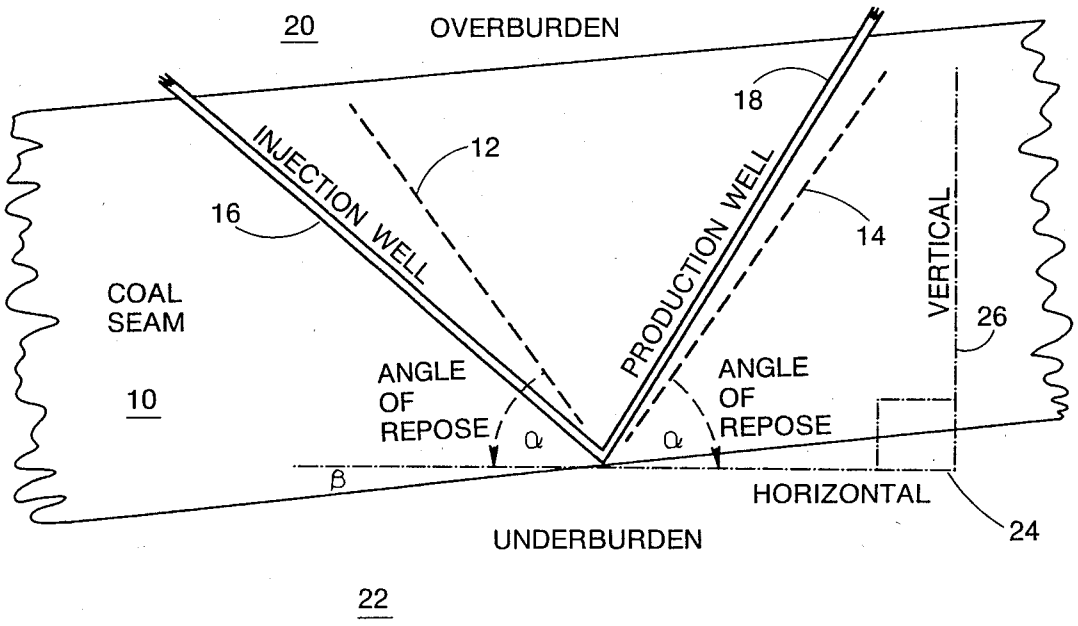
OVERBURDEN
20
VERTICAL
26
24
HORIZONTAL
14
18
PRODUCTION WELL
ANGLE OF REPOSE
α
12
INJECTION WELL
16
ANGLE OF REPOSE
α
β
UNDERBURDEN
22
COAL SEAM
10

METHOD OF PRODUCING SYNTHESIS GAS BY UNDERGROUND GASIFICATION OF COAL USING SPECIFIC WELL CONFIGURATION

FIELD OF THE INVENTION

The present invention relates to a method for gasifying coal in situ and transporting the generated product gases to the earth's surface. More particularly, the invention relates to a novel well configuration, which improves the recovery of coal in thick seams, while at the same time providing the injection and removal wells in a position to reduce the tensile and shearing stresses which may cause breakage.

DESCRIPTION OF RELATED ART

Underground coal gasification (UCG) is a relatively simple process for the in-situ extraction of coal values which has been studied by many workers over the years. Briefly, a pair of process wells (an injector and a producer) some distance apart is drilled from the surface into the coal seam. A combustible material or electrical heater is inserted into one well to ignite the coal. Oxidant gas (usually air, or oxygen-enriched air) is injected into the other well, permeates the coal seam, draws the flame toward the second well by a process of reverse combustion forming a link between the wells. Once linked, an oxidant blast (consisting of air or a mixture of steam and oxygen) is injected at a high rate and low pressure into the injection well and gasification com mences consuming the bulk of the coal between the wells and generating synthesis gas containing a combustible mixture of gases comprising a mixture of hydrogen, carbon monoxide, methane, water and carbon dioxide as principal constituents. Obviously, if air is used, nitrogen is also a principal constituent. As the coal is gasified a void space is formed herein called a cavity. When there are multiple injection and production wells, these cavities can grow together and interact.

The use of slant wells has been suggested in the past. An example of this is Pasini, III, et al., U.S. Pat. No. 3,933,447, (1976) in which slant wells are drilled into a coal seam but which extend horizontally within the seam. For coal layers existing at an angle with the horizontal plane, angle drilling into the seam is shown in Grupping, U.S. Pat. No. 4,243,101 (1981). However, this angle is in effect parallel to the coal seam in the manner of that of U.S. Pat. No. 3,933,447, supra.

Probably the greatest amount of coal gasification work has been carried out in the USSR and angle drilling was used in the Angrenskaya UCG Station. This is described in "The Angrenskaya Underground Coal Gasification Station," by Dolores Olness, a publication of the Lawrence Livermore National Laboratory dated June 17, 1982. In an attempt to protect the wells against subsidence, both injection and exhaust holes were drilled at an angle of 53°–58° to the horizontal. These holes were started through the overburden at an angle of about 60° to the horizontal, an angle stated to correspond to the natural angle of repose for the rocks. The hole was deviated, with a given radius, into the coal seam where it continued in a "near horizontal position" close to the seam floor. The cavities which resulted during gasification were interacting.

The present invention is considered to provide a number of advantages for the in-situ gasification of coal and to provide a major advance in this art.

It is accordingly one object of the invention to provide a method for gasification of coal. A further object of the invention is to provide a method for coal gasification in which improved recovery is obtained, i.e., improved oxygen utilization. A further object of the invention is to provide a system which reduces stress on the wells by positioning them in a particular manner.

Other objects and advantages of the present invention will become apparent to those skilled in the art upon reading this disclosure.

SUMMARY OF THE INVENTION

Broadly, the invention resides in a method of producing synthesis gas by the underground combustion of coal in individual, noninteracting cavities in a thick coal seam, which is generally horizontal under an overburden and where loose coal and char in said seam has a known angle of repose, said seam being provided with an injection well positioned at an angle with respect to the horizontal of less than the angle of repose and with a production well positioned at an angle with respect to the horizontal of greater than the angle of repose, but less than 90°, the distance between said wells decreasing toward the bottom of said seam, comprising linking said wells, initiating combustion near the bottom of said seam, introducing an oxygen-containing gas mixture into said seam through said injection well, and removing combustion products through said production well. This system protects the injection well during the process and places the production well in a position for maximum gasification efficiency while relieving it of tensile and shear stresses.

Preferably, the production and injection wells are drilled to a point near the bottom of the coal seam. After drilling, the wells can be linked by reverse combustion, a process well known in the art. Best results are obtained when the production well is cased through said overburden and completed open hole in the coal seam and said injection well is completely cased. Each cavity in the operation can be individually valved to injection and production pipelines where a number of cavities are used in one coal seam. The oxidant gas can be air or oxygen, or a mixture thereof, steam and oxygen, or carbon dioxide and oxygen. Combustion products comprise, as principal constituents, a mixture of hydrogen, water, carbon monoxide, methane, and carbon dioxide. Generally, the angle of repose in a coal seam is in the range of 50° to 80° and in one situation to be subsequently described, is approximately 65°. Thin stringers in the seam do not interfere with operations according to this invention.

One coal seam in which the process can be used is the Wyodak-Anderson coal of the Fort Union Formation in the Powder River Basin. At one area studied in this seam, the formation forms a shallow syncline, which has a regional dip to the west of about 100 ft/mile (19 m/km). This seam is a subbituminous type-C coal with a moisture content of approximately 26%. The top of the coal seam is at a depth of 630 ft (190 m) and is approximately 100 ft (30 m) thick. The Wyodak-Anderson coal is overlain and underlain by semi-consolidated sandstone-claystone sequences. Vertical flow in the cavity will tend to prevent plugging of flow channels, and the system is therefore applicable to swelling Eastern bituminous coals.

BRIEF DESCRIPTION OF THE DRAWING

Accompanying and forming a part of this application is a single FIGURE showing a cross-section view of a portion of a coal seam and one cavity of the system containing a production well and an injection well.

PREFERRED EMBODIMENTS

The invention can best be understood by consideration of the drawing. In this drawing, a coal seam, which is generally horizontal is designated as 10 which is "thick", i.e., having a thickness in the range of 30 to 100 feet. The angle of repose of loose coal and char is designated by the dashed lines 12 and 14 having an angle of repose of $\alpha$. This coal seam should be generally horizontal, but can have an incline of not more than 20° designated as $\beta$ on the drawing. These angles are measured with respect to the horizontal 24. True vertical is line 26. Production from this coal seam is obtained by drilling an injection well 16 (into which air or oxygen/steam or any other suitable oxidant gas mixture is injected) to intersect or nearly intersect the production well 18 near the bottom of the coal seam. If nonintersecting, they can be linked by reverse combustion. In the coal seam, the injection well is drilled at an angle less than the angle of repose. This will prevent damage to the injection well which might result from subsidence. The production well 18 is drilled at an angle greater than the angle of repose because the coal slumps and falls to the bottom of the production well where it is gasified. These wells can be drilled at any angle through the overburden 20 and deviated through the coal seam 10 at the desired angle to a point near the top of the underburden 22. The production well 18 is preferably cased through the overburden and completed open hole in the coal seam. The injection well 16 is preferably completely cased. However, a portion of the injection well in the coal seam can be completed in such a way as to permit controlled retracting injection point maneuvers as disclosed in the CRIP process practiced by Lawrence Livermore National Laboratories.

The well configuration shown in the drawing is preferably used in individual cavities; i.e., the cavities are not linked to one another below the ground and each cavity is individually valved to injection and production pipelines (not shown). An alternative would be to manifold individual cavities underground, but this is more difficult.

With the well configuration described, oxygen utilization can approach that of Lurgi surface coal gasifiers in that the operation is similar to such packed bed reactors. Oxygen utilization is, of course, the number of mols of synthesis gas (carbon monoxide and hydrogen) produced per mol of oxygen injected. This parameter is important in underground coal gasification economics since oxygen and steam associated with injection comprise around 40% of the investment cost of the facility.

UCG in horizontal coal seams is normally practiced with a horizontal link from injection well to production well at the bottom of the coal seam. Ignition is initiated at the bottom of the coal seam with the intent of keeping the gasification zone near the bottom of the coal seam as long as possible to maximize resource utilization. However, in many of the U.S. UCG field tests, the gasification zone has rapidly risen to the top of the coal seam resulting in a condition termed "gravity override." This causes poor resource utilization because the lower portion of the coal seam is not gasified. Gravity override does not occur in our method because coal and char continue to fall to the bottom of the cavity where the oxidant is being introduced, thus, keeping gasification at the bottom of the cavity.

Preferably, the injection and production wells are linked by drilling and can be enhanced by reverse combustion. In this system, an excess of a combustion supporting gas, such as air or oxygen, is introduced to form a highly volatile and combustible combination within the coal deposit. This can be ignited by electrical means or by the introduction of pyrophoric mixtures.

The coal around the production well can be rubblized to increase the gasification efficiency. This is accomplished by consuming the lower portion of the coal seam (approximately 10–20%) with a downhole heater. Explosive charges in the upper part of the seam can then be used to rubblize the coal. Rubblization of the coal seam can, in some cases, weaken the overburden and increase the effects of subsidence.

The invention has been described herein with reference to certain preferred embodiments. However, as obvious variations thereon will appear to those skilled in the art, the invention is not to be considered as limited thereto.

We claim:

1. A method of producing synthesis gas by the underground gasification of coal in individual noninteracting cavities formed by the gasification of the coal in a thick coal seam which is generally horizontal under an overburden and wherein loose coal and char formed from the combustion of the coal in said seam have a known angle of repose, said seam being provided with an injection well positioned at an angle with respect to the horizontal of less than the angle of repose and with a production well positioned at an angle with respect to the horizontal of greater than the angle of repose but less than 90°, the distance between said wells decreasing toward the bottom of said seam, comprising linking said wells, initiating combustion near the bottom of said seam and thereby producing a cavity in said seam, introducing an oxygen-containing gas mixture into said seam through said injection well, and removing combustion products through said production well.

2. The method of claim 1 wherein the production and injection wells are drilled to a point near the bottom of the coal seam.

3. The method of claim 1 wherein said wells are linked by reverse combustion.

4. The method of claim 1 wherein said production well is through said overburden and completed open hole in the coal seam and said injection well is completely cased.

5. The method of claim 1 wherein each cavity is individually valved to injection and production pipelines.

6. The method of claim 1 wherein the oxidant gas-containing mixture is air, oxygen, an oxygen/steam mixture or an oxygen/carbon dioxide mixture.

7. The method of claim 1 wherein the gasification products comprise a mixture of hydrogen, carbon monoxide, methane, and carbon dioxide as principal constituents.

8. The method of claim 1 wherein the angle of repose is between 50° and 80°.

9. The method of claim 1 wherein the angle of repose is approximately 65°.

10. The method of claim 1 wherein the coal seam is a Western coal seam 30 to 100 ft thick.

11. The method of claim 1 wherein the coal seam is a swelling Eastern bituminous coal.

* * * * *